US010186767B1

(12) United States Patent
Boulais

(10) Patent No.: US 10,186,767 B1
(45) Date of Patent: Jan. 22, 2019

(54) ELEVATION ANGLE CORRECTION FOR A TWO-DIMENSIONAL METAMATERIAL CLOAK

(71) Applicant: Kevin A. Boulais, La Plata, MD (US)

(72) Inventor: Kevin A. Boulais, La Plata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/666,850

(22) Filed: Aug. 2, 2017

(51) Int. Cl.
*H01Q 1/42* (2006.01)
*H01Q 1/36* (2006.01)

(52) U.S. Cl.
CPC ..... *H01Q 1/427* (2013.01); *H01Q 1/364* (2013.01)

(58) Field of Classification Search
CPC ..... H01Q 1/427; H01Q 1/364
USPC ..... 343/872, 742, 867
See application file for complete search history.

(56) References Cited

U.S. PATENT DOCUMENTS

| | | | | |
|---|---|---|---|---|
| 7,525,711 | B1 | 4/2009 | Rule et al. | 359/244 |
| 7,864,394 | B1 | 1/2011 | Rule et al. | 359/244 |
| 8,130,171 | B2 * | 3/2012 | Lam | H01Q 15/02 343/872 |
| 8,390,530 | B2 * | 3/2013 | Werner | H01Q 15/0086 343/841 |
| 9,095,043 | B2 | 7/2015 | Boulais et al. | |
| 2008/0291117 | A1 * | 11/2008 | Schweizer | G02B 1/007 343/911 R |
| 2009/0201221 | A1 * | 8/2009 | Werner | H01Q 1/521 343/909 |
| 2012/0313080 | A1 * | 12/2012 | Boulais | H01L 51/424 257/40 |
| 2014/0203819 | A1 * | 7/2014 | Sessions | G01R 29/0878 324/609 |
| 2014/0238734 | A1 * | 8/2014 | Boulais | H05K 9/00 174/350 |

OTHER PUBLICATIONS

A. Alú: "On the Quest to Invisibility" http://users.ece.utexas.edu/~aalu/index_htm_files/Alu_TedxAustin_Text_Figs.pdf.
F. Monticone et al.: "Invisibility exposed", *Optica 3*, 7 (2006) https://www.osapublishing.org/optica/abstract.cfm?URI=optica-3-7-718.
D. Shurig et al.: "Metamaterial Electromagnetic Cloak at Microwave Frequencies", *Science 314*, 977 (2006) http://www.ece.utah.edu/~dschurig/Site/Publications_files/977.pdf.
N. Landy et al.: "A full-parameter unidirectional metamaterial cloak for microwaves", *Nature Materials 12*, 25-28 (2013) http://search.proquest.com/docview/1284355009?pq-origsite=gscholar.

(Continued)

*Primary Examiner* — Lam T Mai
(74) *Attorney, Agent, or Firm* — Gerhard W. Thielman, Esq.

(57) ABSTRACT

A metamaterial cloak is provided for extending deflection of an electromagnetic beam for a vertical beam angle other than bore sight. The cloak deflects an electromagnetic beam from a source in an environment and includes a laminate structure and an electromagnetic guide. The structure includes a plurality of conductive metal plates and metamaterial layers sandwiched therebetween within a planar shape. The electromagnetic guide is disposed around the laminate structure to provide a frontal face to the source. The guide matches impedance of the laminate structure.

6 Claims, 3 Drawing Sheets

(56) References Cited

OTHER PUBLICATIONS

D. de la Vega: "Mitigation Techniques to Reduce the Impact of Wind Turbines on Radar Services", *Energies 6*, 2859-2873 (2013) http://www.mdpi.com/1996-1073/6/6/2859/pdf.

S. Magnuson: "British Model May Hold Key to Solving Wind Energy, Radar Clutter Problem", *National Defense 95*, 683 26-27 (2010) http://www.nationaldefensemagazine.org/articles/2010/10/1/2010october-british-model-may-hold-key-to-solving-wind-energy-radar-clutter-problem#.

* cited by examiner

ELEVATION ANGLE CORRECTION FOR A TWO-DIMENSIONAL METAMATERIAL CLOAK

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to metamaterial cloaking. In particular, the invention relates to elevation angle correction for extending two-dimensional cloaking via metamaterials towards quasi-three-dimensional cloaking.

Invisibility has fascinated the public even before H. G. Wells wrote *The Invisible Man* (1881). A. Alù in "On the Quest to Invisibility" available at http://users.ece.utexas.edu/~aalu/index_htm_files/Alu_TedxAustin_Text_Figs.pdf summarizes the objective and research of metamaterial cloaking of objects for the lay public at his TED Talk.

An ideal electromagnetic cloak would reconstruct an electromagnetic wave on the cloak's exterior as if the cloak, as well as an object within the cloak, were not there, including properties of electromagnetic phase, group velocity, amplitude and propagation direction. Frequency dispersion, often associated with cloak design, prevents reconstruction of the group velocity, and amplitude, so that a perfect cloak across all frequencies cannot exist. This has been noted by F. Monticone and A. Alù in "Invisibility exposed", *Optica* 3 7 (2016) available at haps://www.osapublishing.org/optica/abstract.cfm?URI=optica-3-7-718. Nevertheless, cloaks have been shown to reconstruct the phase velocity, and approach reconstructing the amplitude as noted by D. Schurig et al. in "Metamaterial Electromagnetic Cloak at Microwave Frequencies", *Science* 314 977 (2006) available at http://www.ece.utah.edu/~dschurig/Site/Publications_files/977.pdf detailing research on microwave cloaking.

Nathan Landy conducted research on unidirectional metamaterial cloaks for his dissertation and published a paper on the concept with D. R. Smith: "A full-parameter unidirectional metamaterial cloak for microwaves", *Nature Materials* 12 25-28 (2013) available for article download at http://search.proquest.com/docview/1284355009?pq-origsite=gscholar on the diamond configuration cloak. This technology has been further pursued in conjunction with sensor arrangements by SensorMetrix in San Diego, Calif. The concept also suffered that the k-vector had to be perpendicular to the central axis of the cloak.

Even though a true cloak is impossible to create, practical benefits accrue for partial cloaking of objects. For example, D. de la Vega in "Mitigation Techniques to Reduce the Impact of Wind Turbines on Radar Services", Energies 6 2859-2873 (2013) available at http://www.mdpi.com/1996-1073/6/6/2859/pdf describes interference from wind turbines on ground-based radar installations. S. Magnuson in "British Model May Hold Key to Solving Wind Energy, Radar Clutter Problem", *National Defense* 95 683 26-27 (2010) also describes signal interference mitigation by electromagnetic cloaking at http://www.nationaldefensemagazine.org/archive/2010/October/Pages/BritishModelMayHoldKeytoSolvingWindEnergy,RadarClutterProblem.aspx?PF=1 because ground radar is often installed at a fixed location. However, to cloak the support pylon of the windmill, a cloak would be needed in which the k-vector could point in planes other than the horizontal.

SUMMARY

Conventional metamaterial cloaks yield disadvantages addressed by various exemplary embodiments of the present invention. In particular, a metamaterial cloak is provided for extending two-dimensional electromagnetic bending into the third dimension. Such embodiments include a cut-section geometry with unequal k-vector paths.

Exemplary embodiments provide metamaterial cloak for extending deflection of an electromagnetic beam for a vertical beam angle other than bore sight. The cloak deflects an electromagnetic beam from a source in an environment and includes a laminate structure and an electromagnetic guide. The structure includes a plurality of conductive metal plates and metamaterial layers sandwiched therebetween within a planar shape. The electromagnetic guide is disposed around the laminate structure to provide a frontal face that matches that phase front of the source, and an exit face that matches that phase front of the source as if the cloak were absent. The guide matches impedance of the laminate structure.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
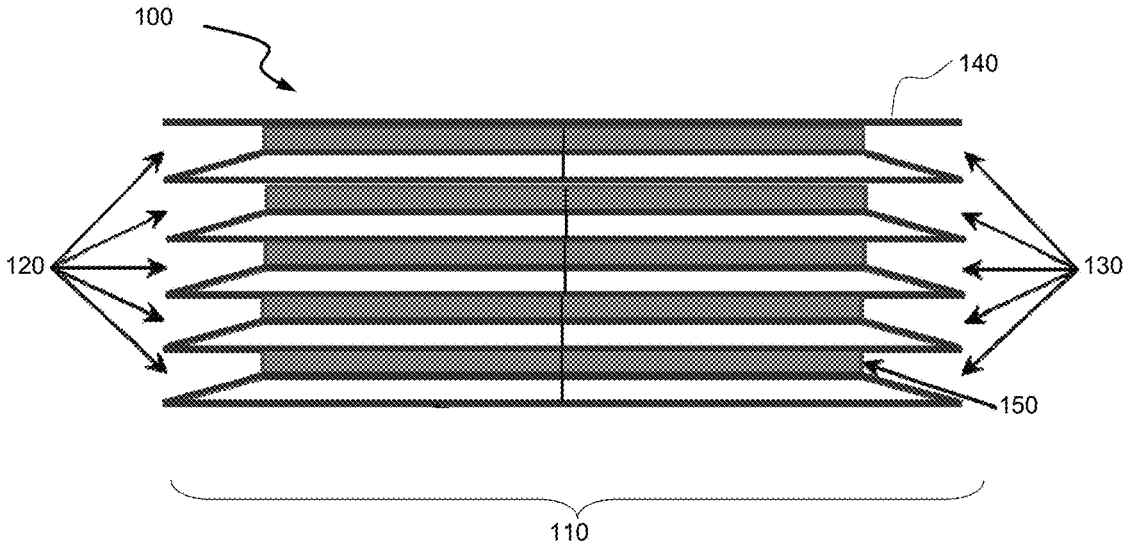
FIG. 1 is an elevation view of a laminated metamaterial cloak.

FIG. 1 shows an elevation cross-sectional view 100 of an edge profile for a waveguide laminated structure 110 for waveguide inputs 120 and waveguide outputs 130. Each waveguide includes a metal conductive plate 140 (e.g., copper) and a metamaterial 150 that fills the gap therebetween. The structure 110 can be used to enable electromagnetic waves of the appropriate frequency to pass around an object enveloped thereby. The concept operates for phase velocity only. In other words, group delay is distorted so that the concept operates ideally for continuous wave electromagnetic radiation. Pulses are distorted to some degree due to group velocity variations. The five-stack configuration of double carpet cloaks forms the three-dimensional structure 110. Artisans will recognize that the number of waveguides is exemplary only and not limiting.

Figure 2:
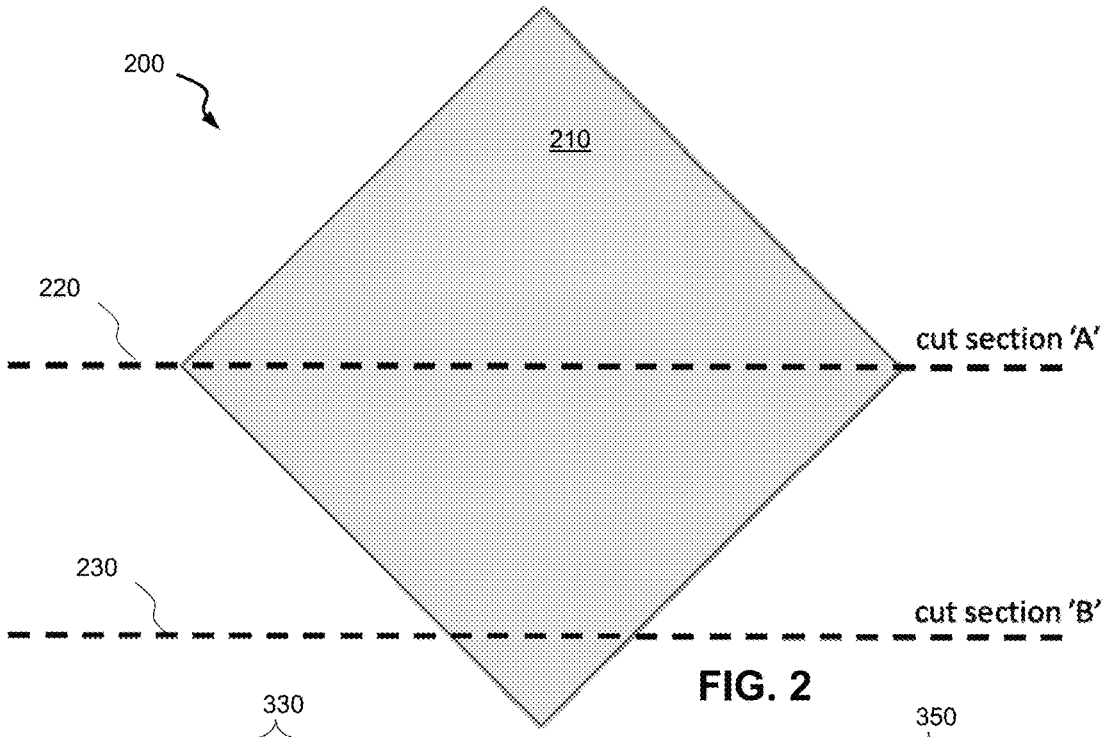
FIG. 2 is a plan view of a laminated metamaterial cloak.

FIG. 2 shows plan cross-sectional view 200 of what is known as a double carpet cloak 210 as diamond shape waveguide part of the stacked structure 110 with cut view sections 220 and 230 for paths in which electromagnetic radiation traverses therethrough called a k-vector. These view sections 220 and 230 correspond to cut sections 'A' and 'B' respectively. For simplicity, the waveguide cloak 210 is assumed to be designed so that its phase velocity is equivalent to ambient surroundings, but this condition is not strictly necessary. Also, ramps or horn like tapers can be disposed on the outer edges to facilitate impedance match any internal structure to any outside environment or to decrease the number of layers by increasing each layer thickness.

An exemplary double carpet cloak 210 can be used as a special lens that enables electromagnetic radiation to pass around a blockage object, and emerge reconstructed in phase on the cloak's opposite side with minimal amplitude loss. Assembled from layers as the laminated structure 110, such a cloak 210 is unidirectional with distortion when radiated at angles other than bore-sight. Distortions at horizontal angles can be minimized, but those at vertical angles can be significant. Exemplary embodiments address the vertical angle distortions for their minimization.

One of the primary causes of the vertical angle distortions arises from the diamond shape of the metamaterial cloak as taught by Landry. Exemplary embodiments disclose a technique to extend the input and output waveguide to form planar input and output faces (or alternate profile depending on the input radiation and related conditions) to thereby correct elevation angle distortions.

Magnitude of the elevation angle depends on the height of the structure. Exemplary embodiments relate only to electromagnetic radiation that flows through the structure. Vertical angles in excess, meaning that the radiation flows above or below the structure 110, cannot be accommodated. Details on the metamaterial portion of the cloak 210 can be addressed by the Landy method, for example. Magnitude of the elevation angle for corrected cloaks is only limited by accommodating input waveguide inputs 120 and output 130.

The problem with elevation angles other than bore sight transmissions lies in the cloak's diamond shape. For example, when an electromagnetic wave approaches the input 120 but at an elevation angle, distortions occur because each ray or k-vector travels a different path through the structure 110. Take for example the two cut sections 220 and 230 through a diamond structure as shown in view 200. The waveguide cloak 210 can be assumed to transmit electromagnetic radiation therethrough at the same velocity as the surrounding media, which is most likely air. The cut sections as paths 'A' 220 and 'B' 230 in which two rays (k-vectors) of electromagnetic radiation are shown to traverse through the double carpet cloak 210 as a waveguide.

Figure 3:
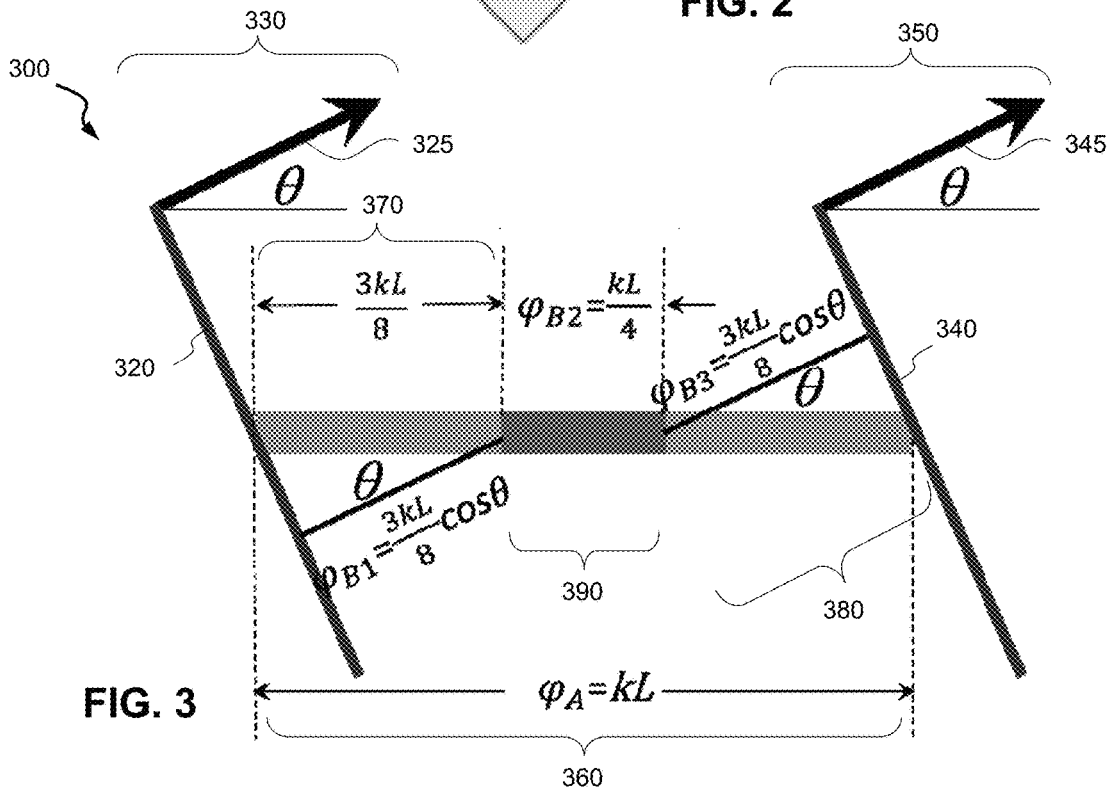
FIG. 3 is a diagram view of a phase shift vectors.

FIG. 3 shows an elevation path view 300 for the double carpet cloak 210. The diagram illustrates the phase shifts taken by a plane wave through path 'A' and path 'B' from the elevation view 300 of the cloak 210, again assuming for simplicity that the refraction index within the cloak 210 is identical to the surrounding medium. However, this need not be the case, and the refraction index can be adjusted by filling surrounding portions of the guide with appropriately accommodating material. In this example, the phase shift can be derived for both paths 'A' 220 and 'B' 230 mathematically from view 300 and that path 'B' has one-quarter (¼) the length of path 'A' through the cloak section for this example.

Total phase shift $\varphi_A$ 360 of the wave that transverse the double carpet cloak 210 through path 'A' 220 can be written as:

$$\omega_A = kL, \tag{1}$$

where k is k-vector, and L is the length traversed through the cloak along path 'A' 220 from input tip to output tip.

The total phase shift $\varphi_B$ of the wave that transverses the double carpet cloak through path 'B' 230 includes the space from the constant phase front to the cloak entrance at path 'B' input, and the space from path 'B' output to the exit constant phase front plane wave. The result is:

$$\varphi_B = \varphi_{B1} + \varphi_{B2} + \varphi_{B3} = \frac{kL}{4}[3\cos(\theta) + 1], \tag{2}$$

where $\omega_{B1}$, $\omega_{B2}$ and $\varphi_{B3}$ are respective paths through free space, through the cloak, and again through free space to match the phase front of the path through cut section 'A' in view 300. The only way to equate eqns. (1) and (2) to be identical is for $\theta = n2\pi$, where n is an integer. This restricts reconstructing a constant phase front that employs the diamond shape of the double carpet cloak to a bore sight elevation angle ($\theta = 0$). Thus the cloak can only operate for k-vectors that are parallel to the guide geometry, rather than for any angle.

In view 300, phase front 320 represents the input plane waves, and vector 325 represents the incoming k-vector, combining together as the input electromagnetic wave 330. Phase front 340 represents the output plane waves in which the phase front would be reconstructed, and vector 345 represents the outgoing k-vector, combining together as the output electromagnetic wave 350. Input and output plane waves 320 and 340 denote constant phase fronts at elevation angle θ.

The total phase shift $\varphi_A$ can be represented as distance 360 between vectors 330 and 350. The total phase shift $\varphi_B$ is determined by sections 370, 380 and 390. Edge sections 370 for $\varphi_{B1}$ and $\varphi_{B3}$ are ⅜$\varphi_A$ multiplied by cos θ. Middle section 390 for $\varphi_{B2}$ is ¼$\varphi_A$. The angled lines 320 and 340 represent plane waves of constant phase at elevation angle θ. The plane waves are positioned at the input and output tips of path 'A' 220 to simplify the algebra.

View 300 features constant phase fronts of a plane wave input 320 and output 340 of a single layer carpet cloak 210 at elevation angle θ. The only condition for which the phase shift for path 'A' 220 and path 'B' 230 can be equal so as to include three components in eqn. (2) requires elevation angle $\theta = 0$ to be zero. These phase shift calculations demonstrate that the double carpet cloak 210 is not able to reproduce the correct phase reconstruction at the output of the guide for elevation angles other than zero due to mismatch between the two paths.

Figure 4:
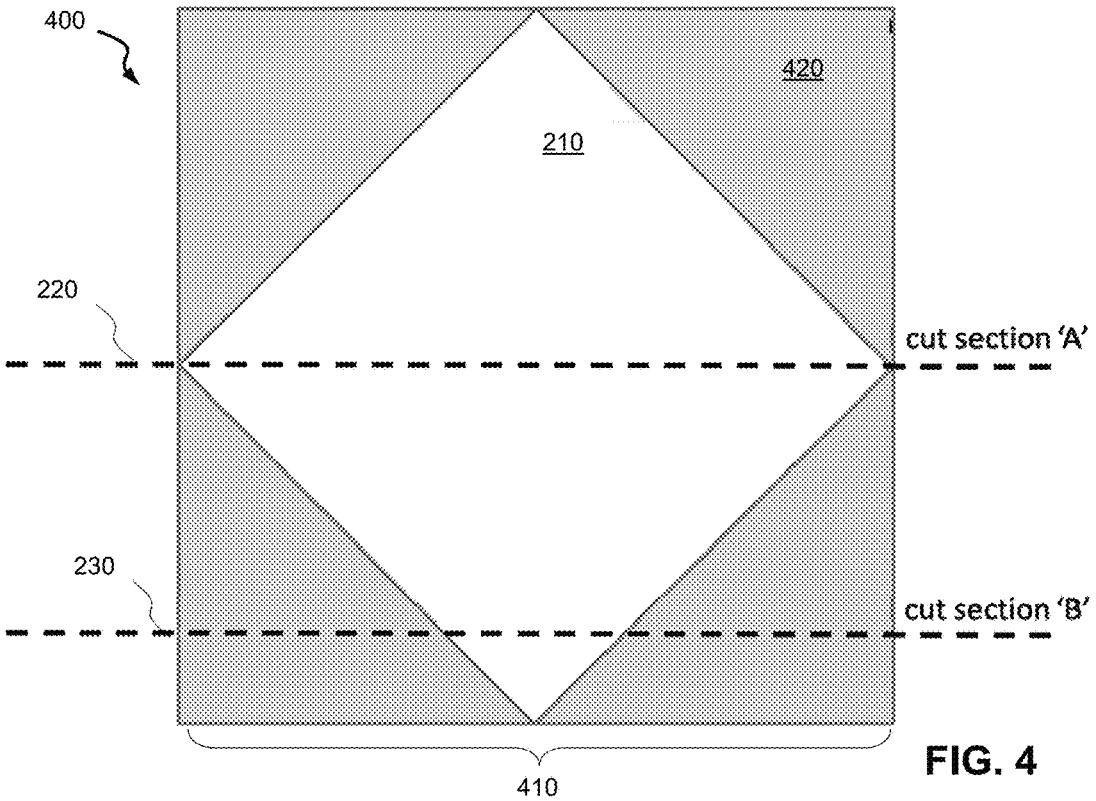
FIG. 4 is a plan view of the metamaterial cloak with correction.

FIG. 4 shows an elevation cross-sectional view 400 of the double carpet cloak 210 as part of a cloak assembly 410 in an additional guide component medium 420 that renders all horizontal path lengths equivalent for a planewave phase front. This eliminates the distortion between paths 'A' 220 and 'B' 230 caused by elevation angles of the electromagnetic radiation that are other than bore sight. This guide 420 can be tapered at the input and output to match free space, if necessary, and filled with dielectric, permeable, both or metamaterial to match the metamaterial of the cloak 210. However, the width of the cloak 210 should accommodate the width of the incoming radiation beam. At elevation angles other than bore sight, radiation that partially transmits through the cloak 210, and partially outside the cloak 420 will have different phase values.

Figure 5:
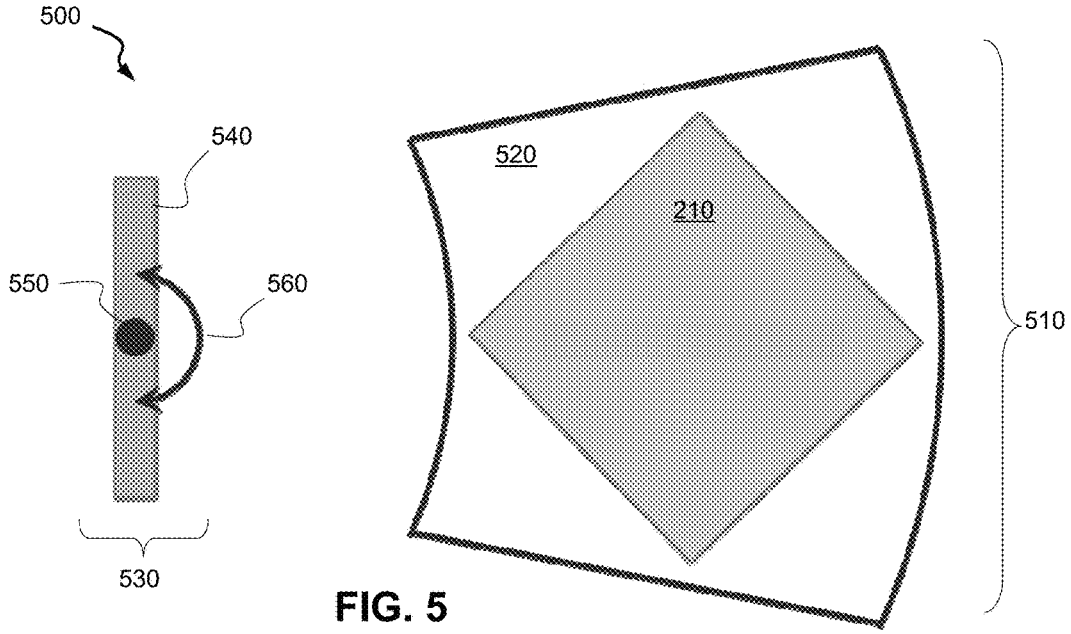
FIG. 5 is a plan view of the metamaterial waveguide with correction variance for a cylindrical phase front.

FIG. 5 shows a plan view 500 of a configuration 510 for a cylindrical electromagnetic phase front envelope 520 with the double carpet cloak 210 enveloped by a similar guide connection as guide component 420, but with cylindrical input and output curves to match that of the material of the envelope 520 in the presence of a rotating radar antenna 530. The envelope 520 presents a circular arc face to the antenna 530 with which to pass electromagnetic radiation therethrough in phase over offsets in elevation.

This demonstrates how alternate shapes for wave-guiding can be added for various conditions. These shapes include the radar antenna or reflector 540, the axis of rotation 550, and the maximum angle of rotation 560. In view 500, the rotating radar antenna 530 emits radially projected electromagnetic radiation. The cloak input and exit faces are matched so that any electromagnetic ray through the cloak 210 exhibits approximately same phase shift for any cut plane section emanating from the rotating radar (due to radar width). An additional advantage to the additional guide component is that the input and output angles of radiation are perpendicular to the face minimizing refractive distortions, and reflective distortions.

Figure 6:
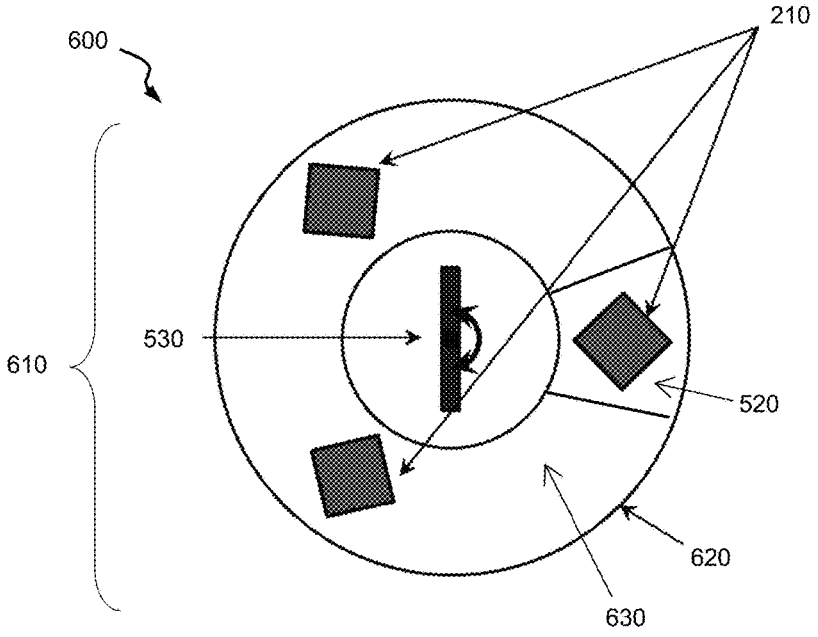
FIG. 6 is a plan view of an operational scenario for a configuration in which three cloaks and relevant corrections.

FIG. 6 shows a plan view 600 of an assembly 610 of an annular correction ring 620 with three exemplary cloaks 210 surrounding the rotating radar antenna 530. The correction ring 620 includes a guide material 630 that envelopes the cloaks 210. The guide material 630 constitutes a circumferential extension of the phase front 520.

One solution to cloaking an object is to render all phase path lengths through the double carpet cloak 210, or similar cloaks, the same electrical length. This can be accomplished by placing the diamond shaped double carpet cloak 210 into a square with waveguide properties that render all path lengths (i.e., all cut sections) through the guide identical, as shown in view 400. Simple tapered electromagnetic horn like structures can be used to impedance match the final structure to that of the outside environment, or to minimize the number of cloak layers.

The additional guide 420 can incorporate the same "horn" structure around the input and output edges to impedance match the internal components to free space. The waveguide cloak 210 then minimizes reflections from the input and output, and can at the same time match the electromagnetic properties of the double carpet cloak. Emphasis is imposed on the index of refraction of the additional guide 420 to match the double carpet cloak 210 so that all electrical path lengths (cut sections) are equivalent.

The material in the additional guide 420 can be filled with dielectric material, permeable material, metamaterial, or any other material necessary to enable the guide index of refraction to match that of the double carpet cloak 210 and/or its surrounding environment to keep all path lengths (cut sections) equivalent in electrical length (phase shift).

In the case that the cloak 210 is placed in front of a rotating radar 530, the faces of the additional cloak 520 can be curved so as to match the angle of rotation and phase front of the radar antenna. In such a case, the cut sections through the guide would be radially emanating to match a spherical or cylindrical phase front, for example. This concept is shown in view 500, such as to reduce blockage of an existing airport radar for example. Aside from military benefits, commercial opportunities could benefit from the exemplary technology, including cell towers, wind-powered turbine towers and other structures that can interfere with radar operations.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A metamaterial cloak for deflecting an electromagnetic beam from a source in an environment, said beam having a phase front, said cloak comprising:

a laminate structure including a plurality of conductive metal plates and metamaterial layers sandwiched therebetween, said laminate structure having a planar shape; and an electromagnetic guide disposed around said laminate structure to provide a frontal face matching the phase front and an exit face matching the phase front, wherein said guide matches impedance of said laminate structure.

2. The cloak according to claim 1, wherein said frontal face of said electromagnetic guide has a flat profile for planewave phase fronts.

3. The cloak according to claim 1, wherein said frontal face of said electromagnetic guide has an arc profile.

4. The cloak according to claim 1, wherein said electromagnetic guide is composed of dielectric material.

5. The cloak according to claim 1, wherein said electromagnetic guide is composed of permeable material.

6. The cloak according to claim 1, wherein said electromagnetic guide is composed of metamaterial.

* * * * *